US007090014B2

(12) United States Patent
Good et al.

(10) Patent No.: US 7,090,014 B2
(45) Date of Patent: Aug. 15, 2006

(54) PROCESS FOR SEQUENTIALLY APPLYING SAGD TO ADJACENT SECTIONS OF A PETROLEUM RESERVOIR

(75) Inventors: William Keith Good, Edmonton (CA); Rick W. Luhning, Edmonton (CA); Kenneth E. Kisman, Calgary (CA)

(73) Assignee: Alberta Science and Research Authority, Edmonton (CA)

( * ) Notice: Subject to any disclaimer, the term of this patent is extended or adjusted under 35 U.S.C. 154(b) by 0 days.

(21) Appl. No.: 10/926,574

(22) Filed: Aug. 25, 2004

(65) Prior Publication Data

US 2005/0082067 A1 Apr. 21, 2005

Related U.S. Application Data

(63) Continuation-in-part of application No. 09/807,855, filed on Oct. 29, 2002, now abandoned.

(51) Int. Cl.
*E21B 43/24* (2006.01)

(52) U.S. Cl. ..... 166/272.3; 166/272.7; 166/401

(58) Field of Classification Search ..... 166/272.3, 166/272.7, 263, 401, 402
See application file for complete search history.

(56) References Cited

U.S. PATENT DOCUMENTS 3,705,625 A 12/1972 Whitten et al.
4,700,779 A * 10/1987 Huang et al. ..... 166/272.3
4,727,937 A * 3/1988 Shum et al. ..... 166/245

FOREIGN PATENT DOCUMENTS

CA 2015460AA 10/1991
CA 2015460 C 12/1993

* cited by examiner

*Primary Examiner*—David Bagnell
*Assistant Examiner*—Giovanna M. Collins
(74) *Attorney, Agent, or Firm*—Sheridan Ross P.C.

(57) ABSTRACT

Steam assisted gravity drainage ("SAGD") is practised in a first section of a reservoir containing heavy oil. When steam/oil ratio rises sufficiently, steam injection into the first section is curtailed or terminated. Non-condensible gas is then injected into the section to pressurize it and production of residual oil and steam condensate is continued. Concurrently with pressurization, SAGD is practised in an adjacent reservoir section. As a result, some of the residual oil in the first section is recovered and steam loss from the second section to the first section is ameliorated.

6 Claims, 2 Drawing Sheets

PROCESS FOR SEQUENTIALLY APPLYING SAGD TO ADJACENT SECTIONS OF A PETROLEUM RESERVOIR

CROSS REFERENCE

This application is a continuation-in-part of U.S. patent application Ser. No. 09/807,855 filed Oct. 29, 2002 now abandoned.

FIELD OF THE INVENTION

This invention relates to recovering heavy oil from an underground reservoir using a staged process involving, in the first stage, steam assisted gravity drainage, and in the second stage, non-condensible gas injection and reservoir pressurization.

BACKGROUND OF THE INVENTION

Steam assisted gravity drainage ("SAGD") is a process first proposed by R. M. Butler and later developed and tested at the Underground Test Facility ("UTF") of the Alberta Oil Sands Technology and Research Authority ("AOSTRA"). The SAGD process was originally developed for use in heavy oil or bitumen containing reservoirs, (hereinafter collectively referred to as 'heavy oil reservoirs'), such as the Athabasca oil sands. The process, as practised at the UTF, involved:

Drilling a pair of deviated wells having horizontal portions positioned close to and above the base of the reservoir containing the heavy oil. The horizontal portion of one well was located above the other in relatively close, generally co-extensive, vertically spaced apart and parallel relationship. The wells were spaced apart about 5–7 meters and extended in parallel horizontal relationship through several hundred meters of the oil pay or reservoir. The upper well was completed or equipped for steam injection. The lower well was completed for flowing production of heated oil and steam condensate. In summary, an associated pair of 'horizontal wells', suitable for the practice of SAGD, were provided;

Then establishing fluid communication between the wells so that fluid could move through the span of formation between them. This was achieved by circulating steam through each of the wells to produce a pair of "hot fingers". The span between the wells warmed by conduction until the contained oil was sufficiently heated so that it could be driven by steam pressure from one well to the other. The viscous oil in the span was replaced with steam by injecting steam through the injection well and producing the oil from the span through the production well. The wells were then ready for SAGD operation;

Then converting to the practice of SAGD production. More particularly, the upper well was used to inject steam and the lower well was used to produce a product mixture of heated oil and condensed water. The production well was operated under steam trap control. That is, the production well was throttled to maintain the production temperature below the saturated steam temperature corresponding to the production pressure. Otherwise stated, the fluids being produced at the production interval should be at undersaturated or "subcooled" condition. (Subcool=steam temperature corresponding to the measured producing production pressure—measured temperature.) This was done to ensure a column of liquid over the production well, to minimize "short-circuiting" by injected steam into the production well. The injected steam began to form an upwardly enlarging steam chamber in the reservoir. The chamber extended along the length of the horizontal portions of the well pair. Oil that had originally filled the chamber sand was heated, to mobilize it, and drained, along with condensed water, down to the production well, through which they were removed. The chamber was thus filled with steam and was permeable to liquid flow. Newly injected steam rose through the chamber and supplied heat to its peripheral surface, thereby enlarging the chamber upwardly and outwardly as the oil was mobilized and drained, together with the condensed water, down to the production well.

This process is described in greater detail in Canadian patent 1,304,287 (Edmunds, Haston and Cordell).

The process was shown to be commercially viable and is now being tested by several oil companies in a significant number of pilot projects.

Now, the operation of a single pair of wells practising SAGD has a finite life. When the upwardly enlarging steam chamber reaches the overlying, cold overburden, it can no longer expand upwardly and heat begins to be lost to the overburden. If two well pairs are being operated side by side, their laterally expanding steam chambers will eventually contact along their side edges and further oil-producing lateral expansion comes to a halt as well. As a result, oil production rate begins to drop off. As a consequence of these two occurrences, the steam/oil ratio ("SOR") begins to rise and continued SAGD operation with an associated well pair eventually becomes uneconomic.

If one considers two side-by-side SAGD well pairs which have been produced to "maturity", as just described, it will be found that a ridge of unheated oil is left between the well pairs. It is, of course, desirable to ameliorate this loss of unrecovered oil.

In Canadian patent 2,015,460 (Kisman), assigned to the present assignee, there is described a technique for limiting the escape of steam into a thief zone. For example, if steam is being injected into a relatively undepleted reservoir section and there is a nearby more depleted reservoir section, forming a low pressure sink, there is a likelihood that pressurized steam will migrate from the undepleted section into the more depleted section—which is an undesired result. One wants to confine the steam to the relatively undepleted section where there is lots of oil to be heated, mobilized and produced. The Kisman patent teaches injecting a non-condensible gas, such as natural gas, into the more depleted section to raise its pressure and equalize it with the pressure in the relatively undepleted section. By this means, the loss of steam from the one section to the other can be curtailed or minimized. This is taught in the context of patterns of vertical wells.

The Kisman patent further teaches that pressurizing the more depleted section with natural gas has been characterized by an increase in production rate from that section, if the production well penetrating the section is produced during pressurization.

SUMMARY OF THE INVENTION

In accordance with the present invention, a novel process is provided for producing adjacent sections of an underground reservoir containing heavy oil. Each section is penetrated by one or more associated pairs of wells completed for SAGD operation, preferably one or more pairs of horizontal injection and production wells. The process comprises:

(a) injecting steam into the first section of the reservoir to practise SAGD and produce contained oil, until the steam/oil ratio rises;

(b) then reducing or terminating steam injection into the first section and injecting non-condensible gas into the section to maintain it pressurized;

(c) continuing to produce oil from the first section while it is so pressurized; and (d) concurrently with step (c), injecting steam into the adjacent second section to practice SAGD therein and produce contained oil;

(e) while preferably maintaining the first section pressurized to substantially the same pressure as exists in the second section during step (d).

Steps (b) and (c) constitute a post-steam wind-down of oil production from the first section. Over time, oil production rate will drop off during wind-down and eventually it will become uneconomic to justify continuing to produce the first section. However it may still be desirable to continue maintaining pressurization in the first section to limit steam loss from the second section.

The process provides a strategy for sequentially producing adjacent sections across the reservoir. It takes advantage of gas pressurization to prevent steam leakage from a less depleted section undergoing SAGD to a mature, more depleted section. It also enhances production from each section by subjecting it to sequential SAGD and pressurization production stages.

Broadly stated, the invention is a method for recovering heavy oil from an underground reservoir, comprising: providing a plurality of pairs of wells, each pair comprising an upper injection well and a lower production well, said well pairs penetrating the reservoir adjacent but above its base and being arranged in laterally spaced apart, side by side arrangement, the wells of each pair having portions that are generally horizontal, spaced apart, parallel and coextensive, said wells being completed and associated so that they can be used for the practice of steam-assisted gravity drainage ("SAGD") production; producing oil from a first reservoir section, using at least one pair of wells completed in said section, by sequentially practicing SAGD and gas pressurization; and producing oil from a second reservoir section, adjacent said first reservoir section, in conjunction with gas pressurization in the first reservoir section, using at least one pair of wells completed in said second reservoir section, by sequentially practicing SAGD and gas pressurization.

DESCRIPTION OF THE PREFERRED EMBODIMENT

Figure 1:
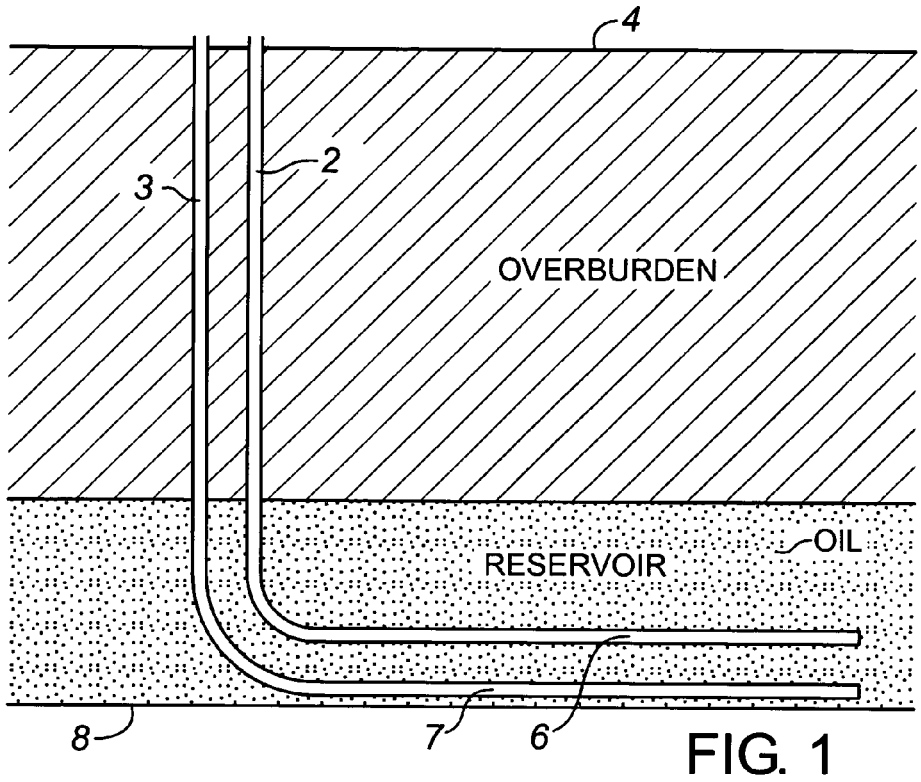
FIG. 1 is a schematic side view showing an associated pair of deviated wells having horizontal portions (said wells being referred to as 'horizontal wells'), said wells penetrating an underground, oil-containing reservoir.
Figure 2:
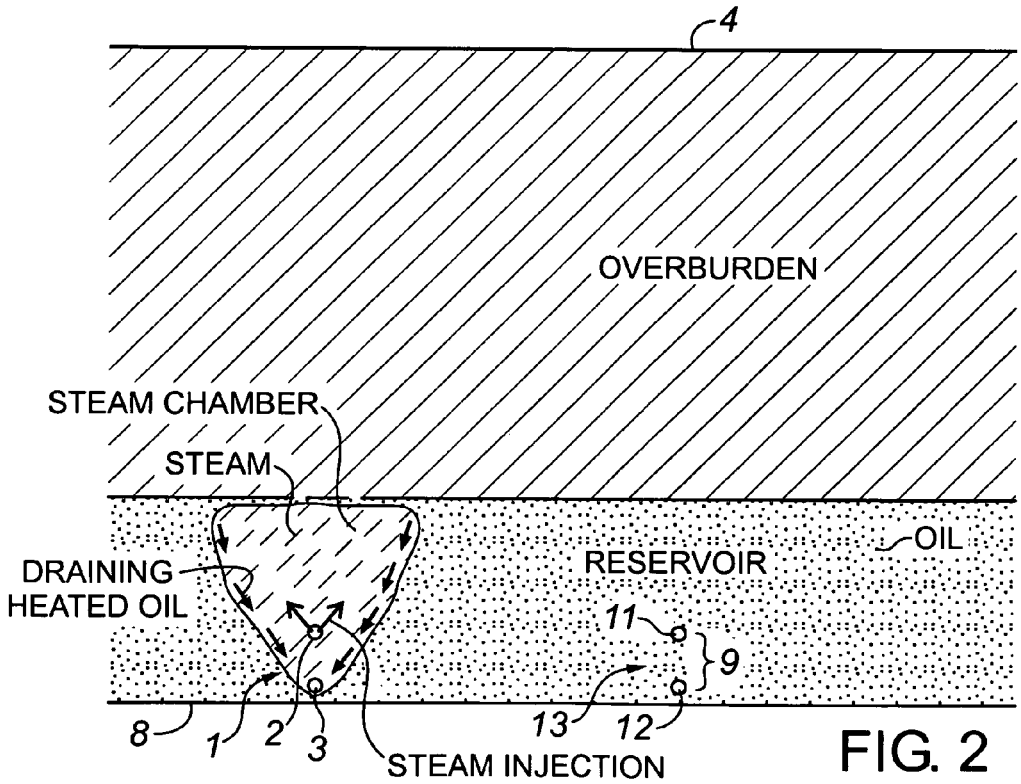
FIG. 2 is a schematic end view showing two associated pairs of horizontal wells positioned in adjacent sections of the reservoir, the first well pair being used to carry on SAGD, with steam being injected through the upper injection well into a steam chamber and a mixture of draining heated oil and condensate water being produced to ground surface through the lower production well, while the second pair of wells remains unused.
Figure 3:
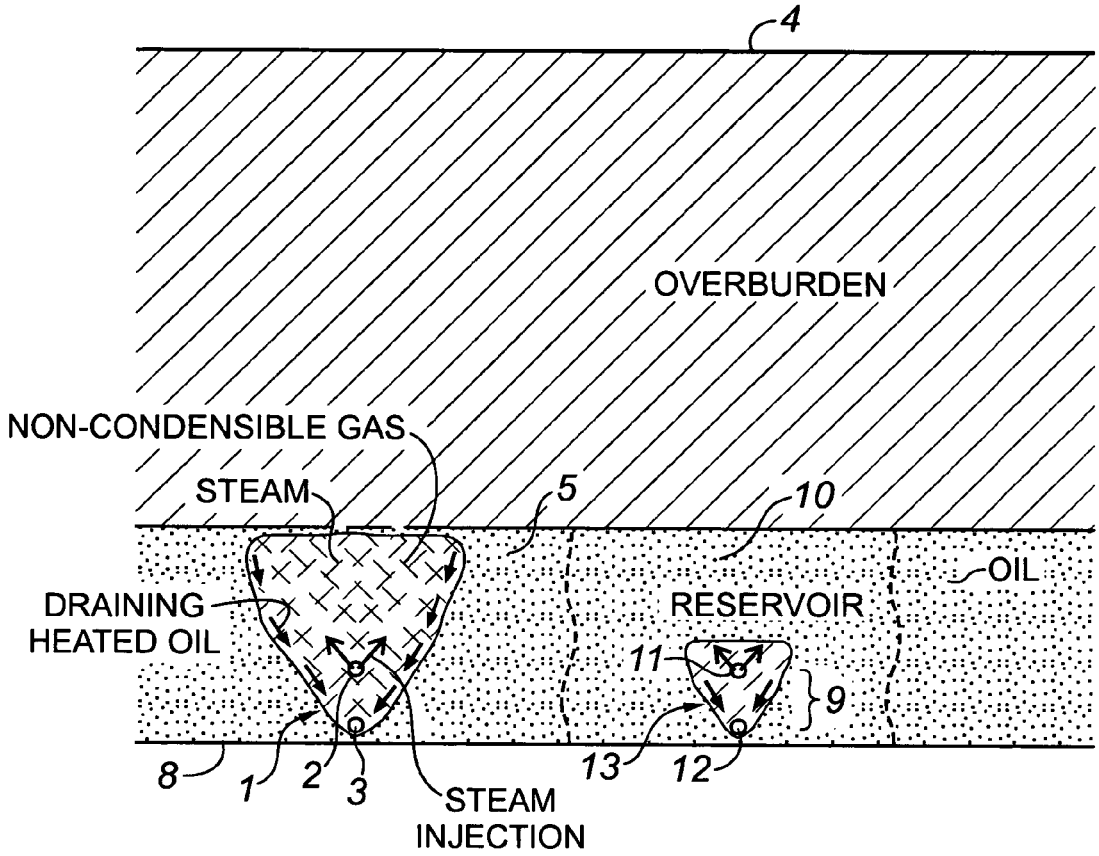
FIG. 3 is also a schematic end view of the two associated well pairs, showing non-condensible gas being injected into a now mature steam chamber through the upper well of the first well pair to pressurize the steam chamber, and a draining mixture of heated oil and condensate water being produced through the lower well, while steam is being injected into a second steam chamber, being developed in the second reservoir section, through the upper well of the second well pair and a draining mixture of heated oil and condensate water is produced through the lower well of the second well pair.

In accordance with one embodiment of the process, it comprises:

(a) directionally drilling one or more deviated first pairs 1 of upper injection and lower production wells 2,3 from ground surface 4 into a reservoir first section 5, to provide generally parallel, co-extensive, vertically spaced apart, horizontal well portions 6,7 extending through the section adjacent its base 8, and completing the wells 2,3 for SAGD production;

(b) establishing fluid communication between the injection and production wells 2,3 of each first pair, for example by circulating steam through both wells, to heat the span 9 between the wells by heat conduction, and then displacing and draining the oil in the span 9 by injecting steam through the upper injection well 2 and opening the lower production well 3 for production;

(c) practising SAGD in the reservoir first section 5 by injecting steam through the injection wells 2 and producing the produced heated oil and condensed water through the production wells 3 while operating said production wells under steam trap control;

(d) preparing a second adjoining section 10 of the reservoir for SAGD production by carrying out the provision of upper and lower 11, 12 wells and establishing fluid communication between the wells of each pair 13 as in steps (a) and (b);

(e) terminating or reducing steam injection into the reservoir first section injection wells 2 and initiating natural gas injection through said injection wells to increase the pressure in the reservoir first section 5 to about the anticipated steam injection pressure in the reservoir second section 10 and maintaining the pressure at about this level while simultaneously producing residual heated oil and steam condensate through the production wells 3 under steam trap control; and (f) concurrently with step (e), practising SAGD in the reservoir second section 10.

In connection with practising steam trap control with wells extending down from ground surface and having riser and horizontal production sections, it is preferred to operate as follows:

measuring the downhole temperature at the injection and production wells of an operating pair, using thermocouples;

establishing the temperature differential between the two wells and throttling the production well to maintain the differential at a generally constant value (say 70°);

monitoring for significant surges in vapour production rate at the ground surface production separator and for surges in steam injection rate; and adjusting throttling to minimize the surges.

Otherwise stated, a generally constant liquid rate at the wellhead is maintained and the bottomhole production temperature is allowed to vary within a limited range.

The invention is characterized by the following advantages:

additional oil is recovered from the mature reservoir section well pairs during the gas pressurization stage, while simultaneously reducing steam leakage from the second reservoir section;

use is made of the residual heat left in the mature reservoir section; and a finite steam-producing plant can be applied in sequence to a plurality of adjacent sections of the reservoir, without severe steam loss from a section undergoing SAGD to an adjacent depleted section.

The invention claimed is:

1. A method for recovering heavy oil from an underground reservoir, comprising:

providing a plurality of pairs of wells, each pair comprising an upper injection well and a lower production well, said well pairs penetrating the reservoir adjacent but above its base and being arranged in laterally spaced apart, side by side arrangement, the wells of each pair having portions that are generally horizontal, spaced apart, parallel and coextensive, said wells being completed and associated so that they can be used for practice of steam-assisted gravity drainage ("SAGD") production;

producing oil from a first reservoir section, using at least one pair of wells completed in said section, by sequentially practicing SAGD and gas pressurization; and producing oil from a second reservoir section, adjacent said first reservoir section in conjunction with gas pressurization in the first reservoir section, using at least one pair of wells completed in said second reservoir section, by sequentially practicing SAGD and gas pressurization.

2. The method as set forth in claim 1 wherein:

SAGD in a reservoir section is conducted by injecting steam through an injection well completed in that section to heat oil in the section and develop a steam chamber while simultaneously producing oil through its associated production well by drainage through the steam chamber.

3. The method as set forth in claim 2 wherein:

gas pressurization in a reservoir section is conducted by injecting a non-condensible gas through an injection well completed in that section while simultaneously producing oil through its associated production well.

4. The method as set forth in claim 3 wherein:

gas pressurization in one section is conducted so as to maintain the pressure therein at about the steam injection pressure in the next adjacent section.

5. The method as set forth in claim 1 wherein:

gas pressurization in a reservoir section is conducted by injecting a non-condensible gas through an injection well completed in that section while simultaneously producing oil through its associated production well.

6. The method as set forth in claim 5 wherein:

gas pressurization in one section is conducted so as to maintain the pressure therein at about the steam injection pressure in the next adjacent section.

* * * * *

UNITED STATES PATENT AND TRADEMARK OFFICE

CERTIFICATE OF CORRECTION

PATENT NO. : 7,090,014 B2
APPLICATION NO. : 10/926574
DATED : August 15, 2006
INVENTOR(S) : William Keith Good et al.

It is certified that error appears in the above-identified patent and that said Letters Patent is hereby corrected as shown below:

Title page of patent, at (63), after "now abandoned" please insert --, filed as 371 of international application No. PCT/CA99/00996, filed on Oct. 26, 1999.--

Signed and Sealed this

Thirtieth Day of January, 2007

JON W. DUDAS
*Director of the United States Patent and Trademark Office*